United States Patent [19]

Sferle

[11] 4,272,074

[45] Jun. 9, 1981

[54] BODY BUILDING APPARATUS

[76] Inventor: Mihai Sferle, 147-25 10th Ave., Whitestone, N.Y. 11357

[21] Appl. No.: 89,530

[22] Filed: Oct. 29, 1979

[51] Int. Cl.[3] ..... A63B 21/00

[52] U.S. Cl. ..... 272/120; 272/142; 272/144

[58] Field of Search ..... 272/134, 120, 144, 72, 272/54, 55, 142; 5/62, 60, 11; 128/2; 248/393, 395, 397

[56] References Cited

U.S. PATENT DOCUMENTS

| | | | |
|---|---|---|---|
| 3,431,020 | 3/1969 | Tyndall | 5/62 X |
| 3,561,022 | 2/1971 | James | 272/54 X |
| 3,658,327 | 4/1972 | Thiede | 272/120 |

*Primary Examiner*—Richard C. Pinkham
*Assistant Examiner*—William R. Browne
*Attorney, Agent, or Firm*—Howard M. Schwinger

[57] ABSTRACT

A body building apparatus consisting of a pyramidal support having a rectangular frame pivotally mounted on its apex at a point substantially intermediate its ends to permit the frame to assume a variety of positions with respect to the horizontal and including a platform slidably mounted thereon to seat the user, grips on which the user may pull to move the platform against his own weight and the force of gravity and an adjustable spacer depending downwardly from the frame for fixing the incline of the frame with respect to the horizontal to vary the resistance of the platform to movement.

5 Claims, 3 Drawing Figures

10
11
11a
12
13
14
15
16
17
18
19
20
21
22
23
24
25
26
27
28
29
30
31
32
33
34
35
36
37
38
39

25
27
28
29

11
11a
14
16
17
18
20
21
22
24
25
26
29
30
31
32
37
38
39

BODY BUILDING APPARATUS

INTRODUCTION

This invention relates to a body building and exercising apparatus.

An important object of the invention is to provide an exercise bench which is operated against the resistance of body weight.

Another important object of the invention is to provide an exercise bench which offers a wide variety of exercising positions.

Still another object of the invention is to provide an exercise bench wherein resistance to movement can be readily varied.

A further object of the invention is to provide an exercise bench which is safe, healthful and will yield a feeling of well being.

These objects and others are accomplished by an exercise bench which essentially includes a pyramidal support, a rectangular frame pivotally mounted on the apex of the support, a platform slidably mounted on the frame, gripping means associated with the frame against which the user may pull to move the platform against his own weight and the force of gravity and means extending between support and frame for adjusting the incline of the frame and varying the resistance of the device.

THE DRAWING

FIG. 1 is a perspective view, partially in phantom to show underlying structure, of an embodiment of the invention, FIG. 2 is a top view of an embodiment of the platform, and FIG. 3 is a side elevational view of the bench of FIG. 1.

DETAILED DESCRIPTION

Figure 1:
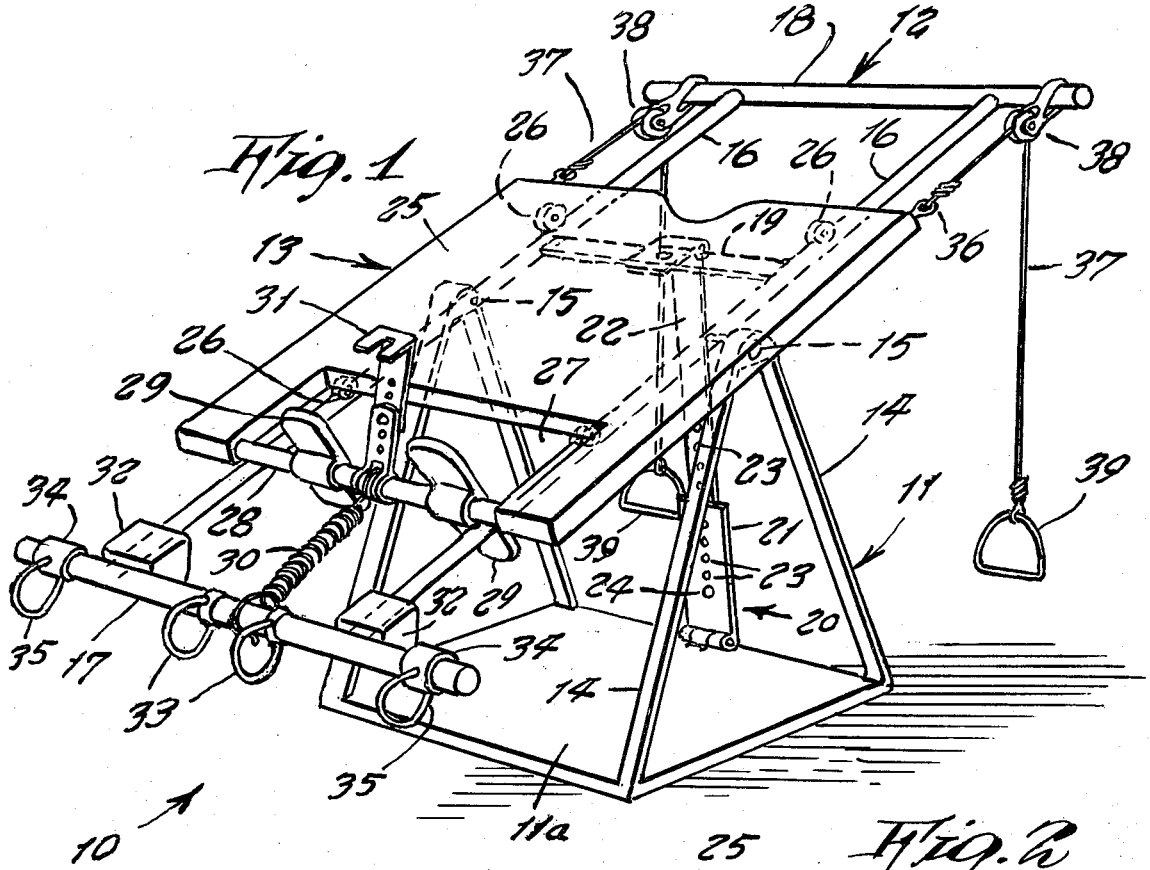
Figure 2:
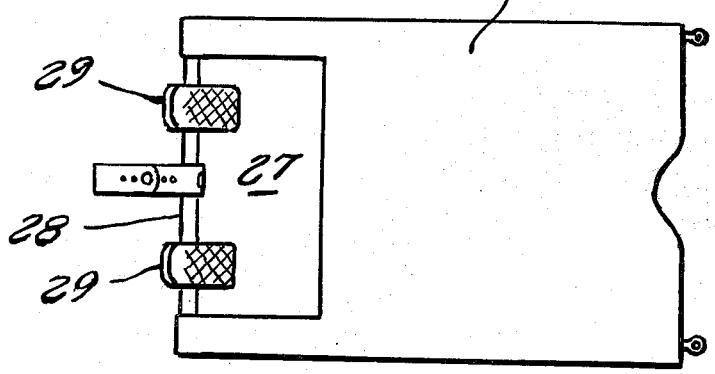
Figure 3:
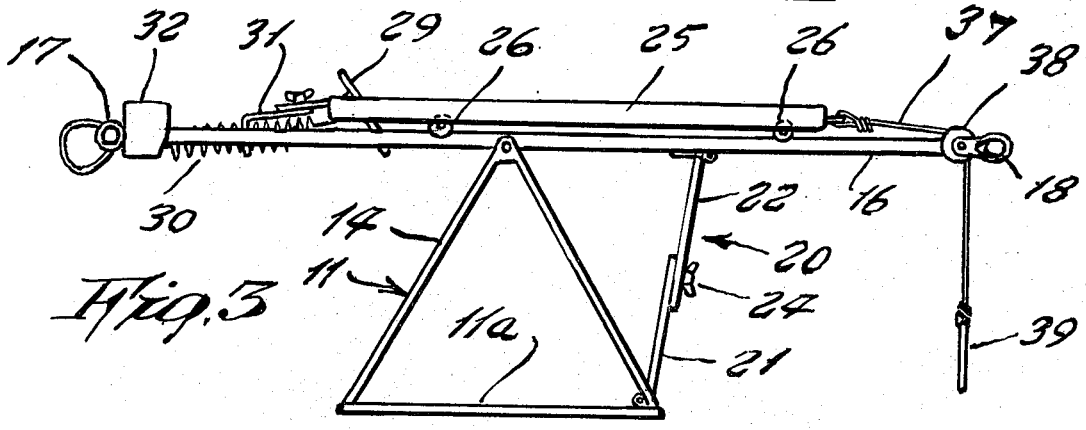

In the drawing 10 indicates an embodiment of an exercise bench in accordance with the present invention. In this instance, the bench includes pyramidal support 11 upon which rectangular frame 12 is pivotally supported and platform 13 slidably mounted on frame 12.

Support 11 includes bottom wall 11*a* and and two pair of legs 14 each pair meeting at their upper ends to form a fulcrum for frame 12. The frame pivots on pins 15.

The frame includes a pair of parallel rails 16 spaced by end members 17 and 18. A member 19 also bridges the frame but intermediate its ends, for reasons hereinafter appearing.

Leg 20 serves to lock the frame in place with respect to the horizontal. The leg is adjustable permitting frame 12 to be inclined as desired. The leg consists of two abutting members 21 and 22, the latter being hingedly connected to the frame at 19. Members 21 and 22 include aligned openings 23 for receiving bolt 24. By moving said members with respect to one another, the frame is inclined as desired and locked in place by bolt 24.

Platform 12 may be cushioned and may be used as a seat as well as a recliner. Rollers 26 secured to the underside of the platform permit it to travel on rails 16 which are provided with tracks or recesses tending to hold the platform to the frame.

An opening 27 provided at the lower end of the platform is bridged by member 28 which supports foot pedals 29. The opening allows for needed leg room.

Platform and frame are still further interconnected by spring 30 whose tension is adjustable by means of member 31 which is pivotally attached to member 28. Bumpers 32 are provided to cushion the impact of platform against the lower portion of the frame when the platform is released. Various handles and hooks are provided on end member 17, such as 33 and 34 and 35.

Another set of handles is provided at the opposite end of the device. These interconnect through cables 37 with the top end of the platform through the medium of pulleys 38 which are mounted on member 12.

The entire apparatus should be made of strong, lightweight material such as aluminum or the like.

In operation, the user may either sit or lie on platform 13. If the sitting position is elected, the user may place his feet on foot pedals 29 and pull on handles 39 in attempting to move the platform forward against his own weight and the force of gravity. The inclusion of spring 30 in the device is optional, the device being functional without it. It will be realized that the device can be operated from a variety of postions, sitting, lying on the back or on the stomach or even squatting. The greater the inclination of the frame, the greater the force required, of course, for travel.

I claim:

1. A body building apparatus comprising a pyramidal support, a rectangular frame pivotally mounted on the apex of the support at a point substantially intermediate its ends to permit the frame to assume a variety of postions with respect to the horizontal and about the apex of the support, a platform slidably mounted on the frame to seat the user, gripping means associated with the frame which the user pulls to move the platform on the frame against his own weight and the force of gravity and an adjustable spacer depending downwardly from the frame for setting the incline of the frame with respect to horizontal and to the apex of the support so as to vary the resistance of the platform to movement along the frame.

2. A device in accordance with claim 1 wherein the pyramidal support is an open framework.

3. A device in accordance with claim 2 wherein the side members of the frame provide a surface for the travel of the platform and at least one of its end members provide the gripping means.

4. A device in accordance with claim 3 wherein the pulling force is transmitted to the platform by means of a cable extending about a frame mounted pulley.

5. A device in accordance with claim 4 wherein the spacer is a leg extending from frame to the base of the support, said spacer being adjustable in length.

* * * * *